United States Patent [19]

Miyazaki

[11] Patent Number: 4,773,250

[45] Date of Patent: Sep. 27, 1988

[54] MODULE-TYPE FORMING MACHINE

[75] Inventor: Hiroshi Miyazaki, Konan, Japan

[73] Assignee: Asahi-Seiki Manufacturing Co., Ltd., Japan

[21] Appl. No.: 32,605

[22] Filed: Apr. 1, 1987

[30] Foreign Application Priority Data

May 28, 1986 [JP] Japan ..... 61-122549

[51] Int. Cl.[4] ..... B21D 7/022; B21D 28/14; B21J 13/08

[52] U.S. Cl. ..... 72/405; 72/336; 72/339; 72/403; 72/446

[58] Field of Search ..... 72/404, 405, 446–448, 72/472, 335, 336, 339, 402, 403

[56] References Cited

U.S. PATENT DOCUMENTS

| | | | |
|---|---|---|---|
| 973,167 | 10/1910 | Caswell | 72/335 |
| 3,052,392 | 9/1962 | Vogt . | |
| 3,092,709 | 6/1963 | Vogt et al. . | |
| 3,256,915 | 6/1966 | Fisher, Jr. et al. | 72/403 |
| 3,562,473 | 2/1971 | Cavagnero et al. | 219/64 |
| 3,591,919 | 7/1971 | Cavagnero | 29/564 |
| 3,675,460 | 7/1972 | Cavagnero et al. | 72/402 |
| 4,203,477 | 5/1980 | Bruller et al. | 72/384 |
| 4,304,347 | 12/1981 | Finzer et al. | 226/150 |
| 4,457,160 | 7/1984 | Wunsch | 72/446 |
| 4,479,376 | 10/1984 | Carlson et al. | 72/455 |
| 4,502,314 | 3/1985 | Wunsch | 72/384 |
| 4,581,917 | 4/1986 | Moriyama et al. | 72/446 |

*Primary Examiner*—Daniel C. Crane

*Attorney, Agent, or Firm*—Parkhurst, Oliff & Berridge

[57] ABSTRACT

A module type forming machine having a central driving wheel gear rotatable about a horizontal axis and disposed behind a working table extending in a vertical plane, and a plurality of slide units including slides which are arranged radially around the central driving wheel gear and which carry forming tools at their radially inner ends, the slides being linearly slidable in the radial directions by the operation of the respective pinions meshing with the central driving wheel gear. The forming machine further has a base detachably attached to a lateral side of the frame of the forming machine, the base carrying an upper shaft and a lower shaft and a plurality of working units adapted to be driven by the upper or the lower shaft so as to perform linear vertical working motions and arranged in a side-by-side fashion. The forming machine can conduct a variety of works by virtue of provision of two shafts on the base and can cope with demands for various forming operations having different number of steps owing to the detachable nature of the base.

1 Claim, 7 Drawing Sheets

IV
IV
NO.1
NO.2
NO.3
NO.4

MODULE-TYPE FORMING MACHINE

BACKGROUND OF THE INVENTION

1. Field of the Invention

The present invention relates to a module-type forming machine for effecting various punch press works on metallic strips besides various forming operations thereby producing articles of desired forms from said strips.

2. Description of the Prior Art

An apparatus generally known as a multi-forming machine, multi-slide press or a punching and forming machine is adapted to effect a series of forming operations on a metal strip which is continuously fed by a feeder. More specifically, in the operation of this apparatus, a punch press work such as trimming, hole-punching or embossing is first effected on the metal strip. The metal strip is then fed to a forming section after being cut into a desired length as required. In the forming section, the strip, if it has not been cut, is cut into the desired length or a blanking is effected on the cut strip. The cut strip is placed on a mandrel and a series of forming operations are effected by means of a plurality of forming tools which are arranged radially around the mandrel. The formed article is then removed from the mandrel by means of a stripping tool of a stripper device. Thus, a plurality of formed articles are successively obtained through a series of forming operations.

This type of the apparatus is broadly sorted into two types: namely, a first type in which cam shafts for driving a punching press and a forming slide are provided on four sides of a working table, and a second type which incorporates a rotatable central driving wheel gear which meshes with pinions attached to the forming slide and the punching press. The second-mentioned type of the forming machine adopts such a rational arrangement that the forming slide unit, punching press and the strip feeder are disposed on the front and lateral side of the working table while the stripper device is disposed on the rear side so that these components are driven by the central driving wheel gear.

This apparatus, however, cannot well cope with demands for production of articles having complicated shapes and fails to meet the demand for fully automatic operation for the purpose of improving the production efficiency, because the components are adaptable only to limited ranges of works. Thus, it is often required to design and construct another apparatus for the production of a different kind of product.

SUMMARY OF THE INVENTION

Accordingly, an object of the present invention is to provide a module-type forming machine which employs a central driving wheel gear, wherein the forming performance of the machine is improved so as to cope with demands for production of an article having complicated shape.

Another object of the present invention is to provide a module-type forming machine of the type described above, wherein the press section of the machine is constructed so as to be detachably mounted on the machine, thus enabling the forming performance to be changed in accordance with the number of steps of the forming process.

To these ends, according to one aspect of the present invention, there is provided a module-type forming machine having a frame provided on the front side thereof with a working table which extends in a vertical plane, a central driving wheel gear disposed behind the working table and mounted in the frame for the rotation about an axis which is perpendicular to the plane of the working table, a forming station disposed on the axis of the central driving wheel gear and provided on the surface of the working table, a plurality of slide units attached to the surface of the working table and having the respective slides which are operatively connected to the central driving wheel gear to be slidable in the radial direction towards and away from the forming station, the slides carrying respective forming tools at their ends adjacent to the forming station, and driving means for driving the central driving wheel gear, the module-type forming machine comprising: a base attached to a lateral side of the frame and having T-shaped grooves which extend horizontally in parallel to the vertical plane of the working table; a plurality of working units having portions received in the T-shaped grooves and adapted to be fixed to the base at desired positions selected along the T-shaped grooves; an upper shaft and a lower shaft which are rotatably supported by the base and extending in parallel with the T-shaped grooves at the upper and lower portions of the base; means for driving the upper and lower shafts in synchronism with the rotation of the central driving wheel gear; means for operatively connecting the working units to the upper shaft or the lower shaft; and a stock feeding device for intermittently feeding a stock to the forming station past the working units.

In a preferred form of the present invention, the upper shaft and the lower shaft are driven by a drive shaft which is provided on the base in such a manner that it is disengageably connected to the driving means for driving the central driving wheel gear, while the base is detachably mounted on the frame.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
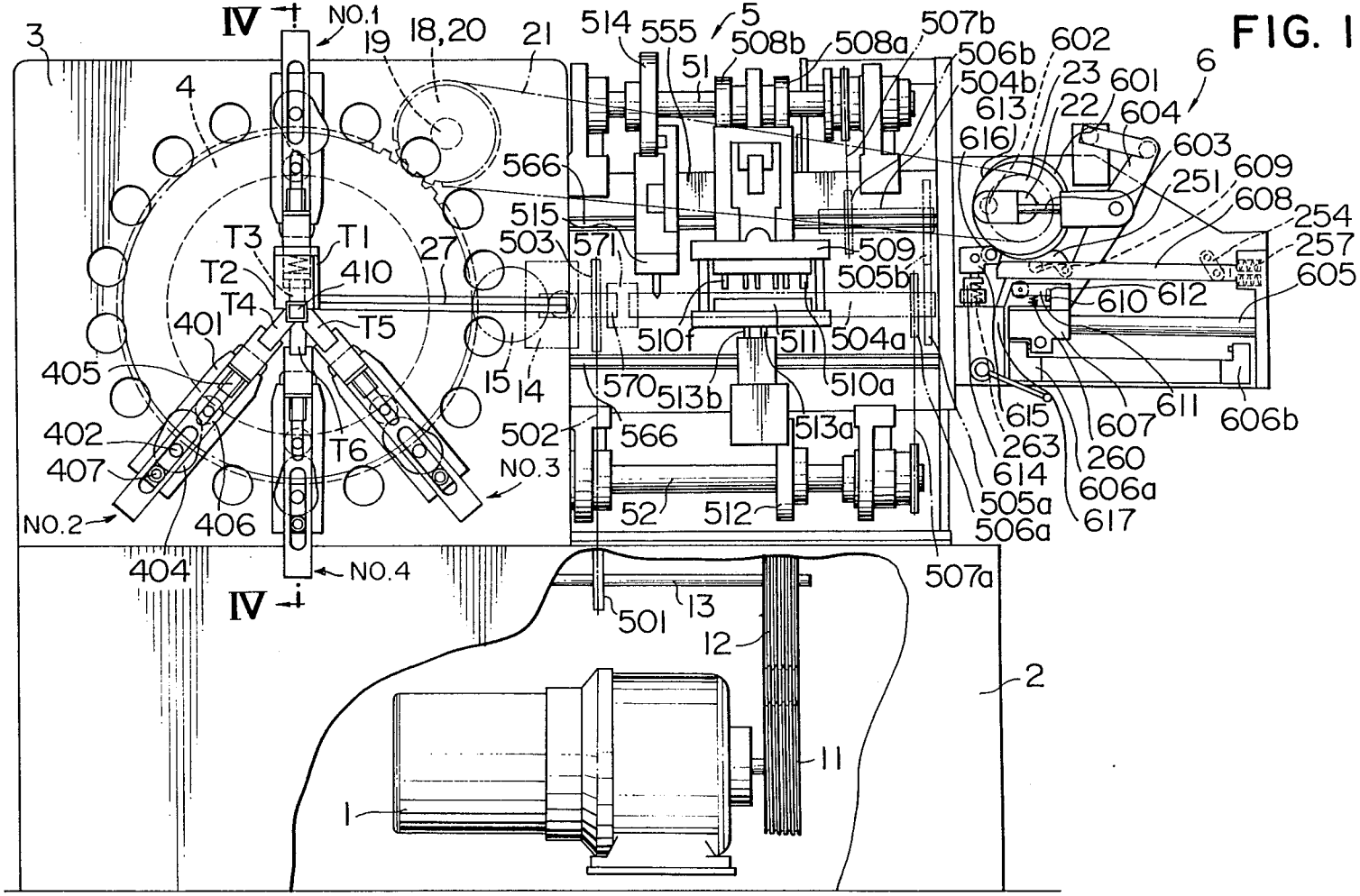
FIG. 1 is a front elevational view of an embodiment of a forming machine in accordance with the present invention.
Figure 3:
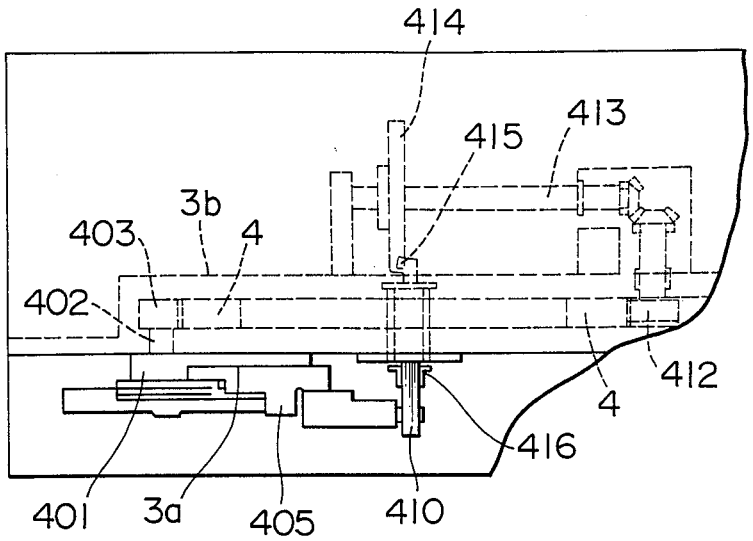
FIG. 3 is a plan view of an example of a slide unit incorporated in the forming machine of the present invention.
Figure 4:
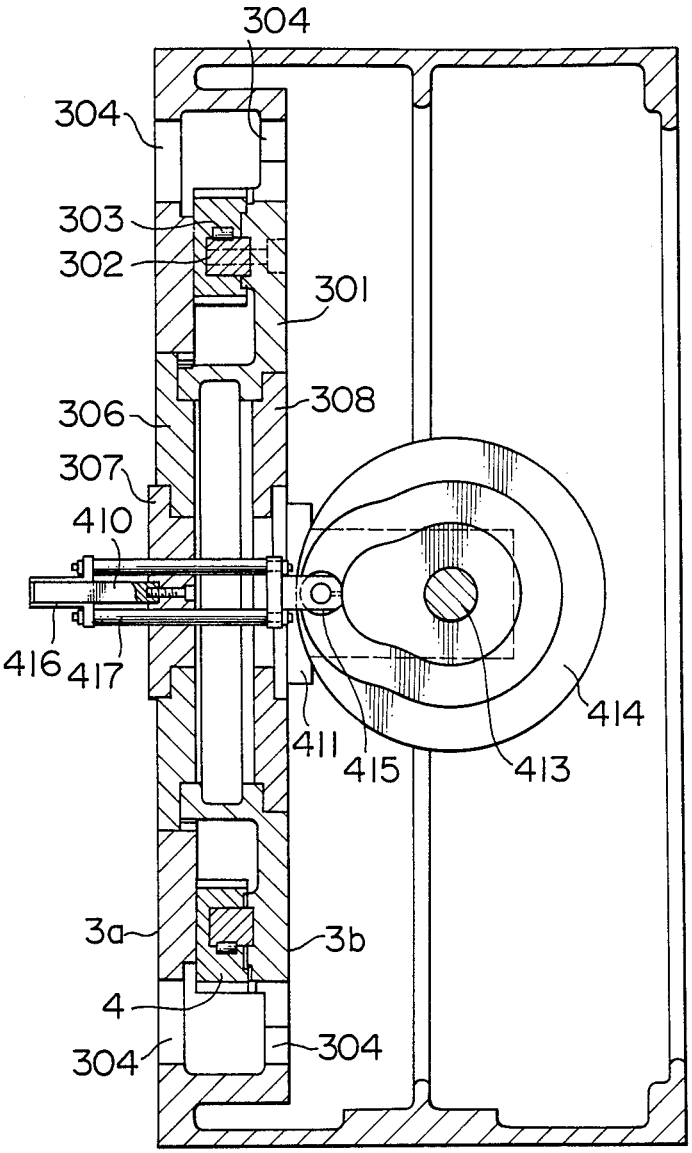
FIG. 4 is a sectional view of the forming machine shown in FIG. 1 taken along the line IV—IV of FIG. 1 with the slide unit thereof being removed and a stripper unit thereon.

Referring to FIG. 1, a drive motor 1 with a reduction gear is built-in in a frame base 2 on which stands a frame 3 perpendicularly. A press section 5 is detachably attached, to the right side of the frame 3 as viewed in FIG. 1. A stock feeding device 6 for feeding a metal strip is provided detachably on the right side of the press section 5. A central driving wheel gear 4 is mounted in the frame 3 so as to be able to rotate about a horizontal axis. As will be seen from FIG. 4, a front working table 3*a* and a rear working table 3*b* are provided on the front and the rear sides of the central driving wheel gear 4 so as to present flat vertical surfaces. The central driving wheel gear 4 is driven by the drive motor 1 through a pulley 11 attached to the output shaft of the drive motor 1, a pulley 12 which is drivingly connected to the pulley 11 through a belt, a drive shaft 13, a sprocket 501, a sprocket 503 drivingly connected to the sprocket 501 through a chain 502, an intermediate shaft 570, a bevel gear train 14 and an intermediate gear train 15. The central driving wheel gear 4 is rotatably carried through rollers 303 by an annular ridge 302 fixed to a holder plate 301 which constitutes an outer peripheral portion of the rear working table 3*b*. A plurality of holes 304 for receiving pinions which are meshed with the central driving wheel gear 4 are formed through the frame 3 and the holder plate 301 on a circle which is concentric with the central driving wheel gear 4. A front plate 306 is attached to the center of the front working table 3*a* and a front tool plate 307 is attached to the center of the front plate 306. A rear plate 308 is attached to the center of the holder plate 301. Various forming tools necessary for the forming operations are attached to slide units which in turn are provided on the front working table 3*a*. The slide units have slide bases 401 which are secured radially in such a manner that the tool mounting portions of the slide units are directed radially inwardly towards the center such that they can effect forming operations on an object at the forming position which is on the center of the front working table 3*a*. As will be seen from FIG. 3, each slide base 401 rotatably carries a drive shaft 402 perpendicularly thereto. A driving pinion 403 carried by the end of the drive shaft 402 meshes with the central driving wheel gear 4. A cam 404 is keyed to the drive shaft 402 as will be seen from FIG. 1. Cam followers 406 and 407 provided on a slide 405 contact with the cam 404, so that the slide 405 carrying the tool is moved back and forth in the radial direction in accordance with the rotation of the central driving wheel gear 4. In most cases, the slide units are arranged radially around the central forming position or, alternatively, arranged in parallel on the upper and lower sides of a path along which the stock strip is fed. A mandrel 410 having a configuration conforming with the shape of the article to be formed is replaceably secured to the front tool plate 307 at the central forming position so as to extend perpendicularly to the front tool plate 307.

The forming machine also is provided with a stripper device which is adapted for removing the formed article from the mandrel 410. The stripper device has a stripper base 411 at which it is secured to the rear plate 308 and the holder plate 301 by means of bolts in such a manner as not to interfere with any slide units. As will be seen from FIG. 3, the stripper base 411 rotatably carries a cam shaft 413 which is drivingly connected through level gears to the pinion shaft having a pinion 412 which meshes with a central driving wheel gear 4 and extending in parallel with a surface of the rear plate 308. A stripper cam 414, which is a groove cam in the illustrated embodiment, is attached to the cam shaft 413. A cam follower 415 engaging with the stripper cam 414 is connected through a guide rod 417 slidably penetrating the front tool plate 307 to a stripper tool 416 which is adapted to slide along the mandrel 410 on the front tool plate 307.

Figure 2:
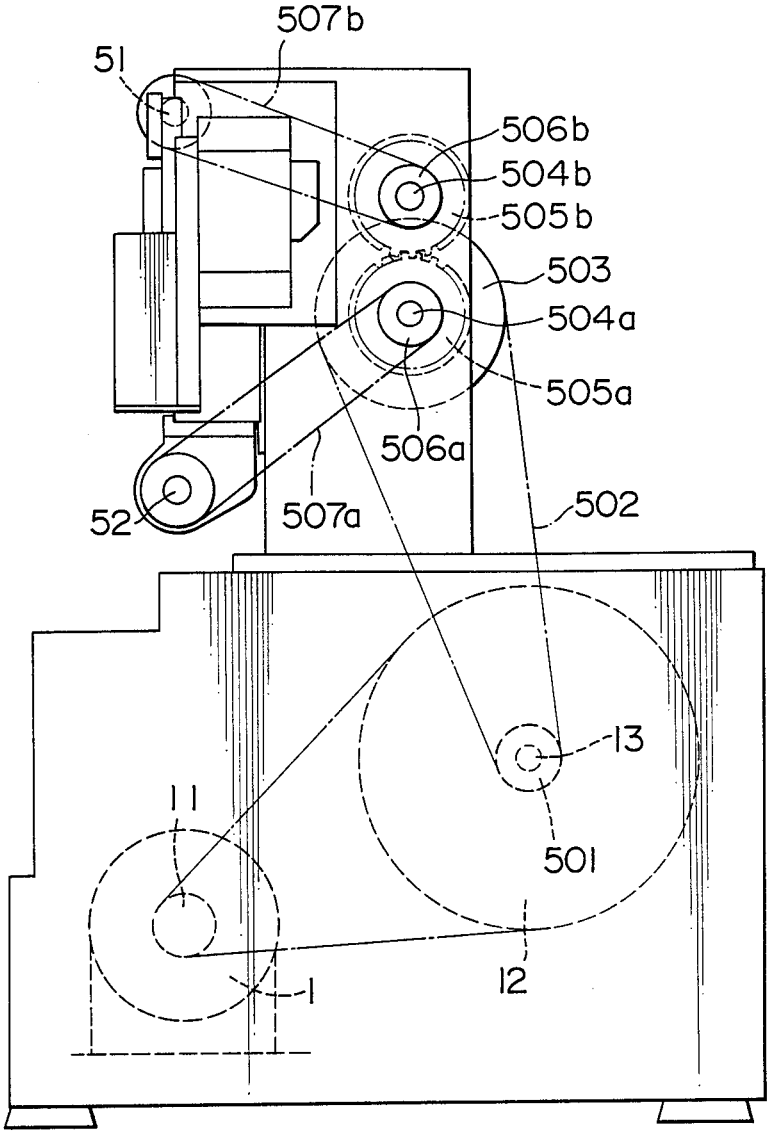
FIG. 2 is a side elevational view of the forming machine shown in FIG. 1 as viewed from the right side thereof.

Referring back to FIG. 1, the press section 5 attached to the right side of the frame 3 is adapted to be attached selectively in accordance with the configuration of the article to be produced. The press section 5 has an upper shaft 51 and a lower shaft 52 for actuating pressing means such as a ram. As will be seen from FIG. 2, the lower shaft 52 is driven by the drive shaft 13 through the sprocket 501, chain 502, sprocket 503, the intermediate shaft 570 driven by the sprocket 503, an intermediate shaft 504*a* driven through a coupling 571, a sprocket 506*a* fixed to the intermediate shaft 504*a*, a chain 507*a* and a sprocket attached to the lower shaft 52. On the other hand, the upper shaft 51 is driven by the same drive shaft 13 through the sprocket 501, the chain 502, sprocket 503, intermediate shaft 570 driven by the sprocket 503, the intermediate shaft 504*a* driven through the coupling 571, meshing intermediate gears 505*a*, 505*b*, another intermediate shaft 504*b* which rotate in the counter direction to the direction of rotation of the intermediate shaft 504*a*, sprocket 506*b* chain 507*b* and a sprocket fixed to the upper shaft 51. T-shaped grooves 566 are formed in a base 555 of the press section 5, so that the positions of the units attached to the base 555 such as a press unit, tapping unit, knock-out unit and a welder are adjustable in the left and right directions by virtue of the T-shaped grooves 566. Bearings for rotatably supporting the upper shaft 51 and the lower shaft 52 are provided on the upper and lower sides of the base 555.

In this embodiment, the upper shaft 51 or the lower shaft 52 driven by the driven shaft 13 causes a pressing cam 508*a* or a pulling cam 508*b* to be rotated, thereby activating punches 510*a* to 510*f* fixed to a ram 509. In consequence, the punches 510*a* to 510*f* cooperate with a die 511 fixed to the underside of the press section 5, thereby effecting press works such as punching, bending and so forth. Similarly, knock-out punches 513*a* and 513*b* of the knock-out unit are activated by a cam 512 on the lower shaft 52 and the tapping unit 515 is driven by a cam 514 which is carried by the upper shaft 51. The thus machined strip is then fed onto the mandrel 410 by means of a stock feeding device 6, while being guided by a stock guide 27 which is fixed to the surface of the front working table 3*a*.

The stock feeding device 6 has a stock feeding cam shaft 22 which is driven by the central driving wheel gear 4 through an intermediate gear 18 connected to the central driving wheel gear 4, a sprocket 20 secured to a shaft 19 carrying the intermediate gear 18, a chain 21 and a sprocket 23. When the article to be formed does not necessitate any press work to be conducted by the press section 5, the stock feeding device 6 is attached directly to the right side of the frame 3. In such a case, it is necessary to replace the chain 21 with a shorter one. An eccentric pin 602 is attached to a gripper cam 601 fixed to the stock feeding cam shaft 22 adapted to be rotated in synchronism with the central driving wheel gear 4. The amount of eccentricity of the eccentric pin 602 is adjustable. A rod 603 pivotally connected to the eccentric pin 602 is connected to a link lever 604 the lower end of which is connected to a feed block 607. The feed block 607 is adapted to slide on a guide rod 605. The stroke ends of the feed block 607 and, hence, the amount of feed is determined by stoppers 606*a* and 606*b* the positions of which are adjustable. The rod 603 has two springs in the end thereof adjacent to the link lever 604. The arrangement is such that, when the feed block 607 is stopped by the stopper 606*a* or 606*b* each one of the springs is compressed so a to stop the movement of the link lever 604. A cam follower 609 attached to one end of an L-shaped lever 251 engages with the gripper cam 601, while the other end of the L-shaped lever 251 is pivotally connected to a parallel link 608. The other end of the parallel link 608 is pivotally connected to the lower end of rocker lever 254. The arrangement is such that, when the parallel link 608 suspended by the L-shaped lever 251 and the rocker lever 254 is made to rock, it moves slightly up and down while keeping horizontal posture. Normally, the parallel link 608 is urged by a spring 257 towards the press section 5, so as to keep the cam follower 609 in pressure contact with the gripper cam 601. A gripper lever 611 is pivotally connected to the feed block 607. The gripper lever 611 is provided on the distal end thereof with a roller 612 and on the base portion thereof with a gripper 610. The gripper lever 611 is normally urged upward by a spring 260, so that the roller 612 rolls on the lower surface of the parallel link 608 when the feed block 607 slides on the guide rod 605. At the same time, a stock check cam 613 is secured to the stock feeding cam shaft 22 in a side-by-side fashion to the gripper cam 601. A roller 616 provided on an end of a stock check cam lever 615 is adapted to engage with the stock check cam 613. A fixing member 614 secured to the stock check cam lever 615 is adapted to be urged upward by means of a spring 263.

The stock feeding device 6 has the construction described hereinabove. In operation, as the feed block 607 moves forward, the parallel link 608 is lowered by the gripper cam 601 so that the gripper lever 611 also is lowered with the result that the gripper 610 is lowered to grip the stock so as to feed the same towards the press section 5. When the feed block 607 is moved backward, the gripper cam 601 is in the phase in which it lifts up the parallel link 608, so that the gripper 610 is moved upward while releasing the stock. The stock check cam 613 operates in synchronism with this operation, such as to activate the fixing member 614 thereby lowering the same while the gripper 610 is opened, thus stationarily holding the stock.

Figure 5:
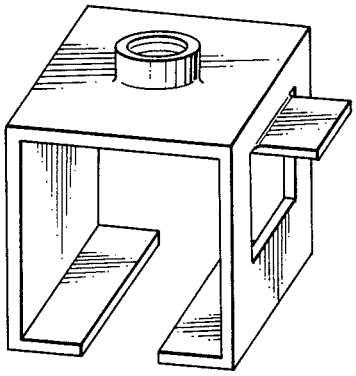
FIG. 5 is a perspective view of an example of articles formed by the forming machine shown in FIG. 1.

The operation of the forming machine of the invention having the described construction will be explained hereinunder. It is assumed here that an article shown in FIG. 5, provided with tapped hole and an aperture with a visor in its two sides is to be formed from a stock cut from a strip. In order to form the aperture with the visor and the tapped hole in predetermined regions along the length of the strip, the press section 5 is attached to the right side of the frame 3, and the intermediate shaft 504*a* of the press section 5 is drivingly connected to the intermediate shaft 570 of the central driving wheel gear 4 through the coupling 571. Then, the positions of the stoppers 606*a* and 606*b* are adjusted so as to determine the amount of feed to be performed by the stock feeding device 6. The mandrel 410 having a configuration conforming with the shape of the article to be produced is secured and the stripper tool 416 is mounted so as to be able to slide on the mandrel 410. The slide unit carrying a forming tool No. 1 is vertically fixed at a position right above the mandrel 410 and the driving pinion 403 thereof is made to mesh with the central driving wheel gear 4. A cutting tool T1 is secured to the end of the slide 405 of this slide unit. A U-bending tool T2 is secured to the slide 405 leaving a small gap between itself and the tool T1, together with a pressing tool T3 which is vertically slidable in the U-bending tool T2 and normally urged downward by a spring. Slide units which carry forming tool Nos. 2 and 3 for inwardly bending the ends of the sheet stock which has been bent in an inverted U-shape are secured at positions which are spaced from the slide unit carrying the forming tool No. 1 by 140° both in the clockwise and counter-clockwise directions, such that the inner ends of these slide units are directed towards the center. L-bending tools T4 and T5 which are provided in their end surfaces with notches cut at 90° are attached to the ends of the slides of these slide units. Another slide unit for a forming tool No. 4 which is intended for determining the final bend of the stock is secured vertically so as to direct its end towards the center. A final pressing tool T6 is attached to the slide 405 of this slide unit.

Figure 8:
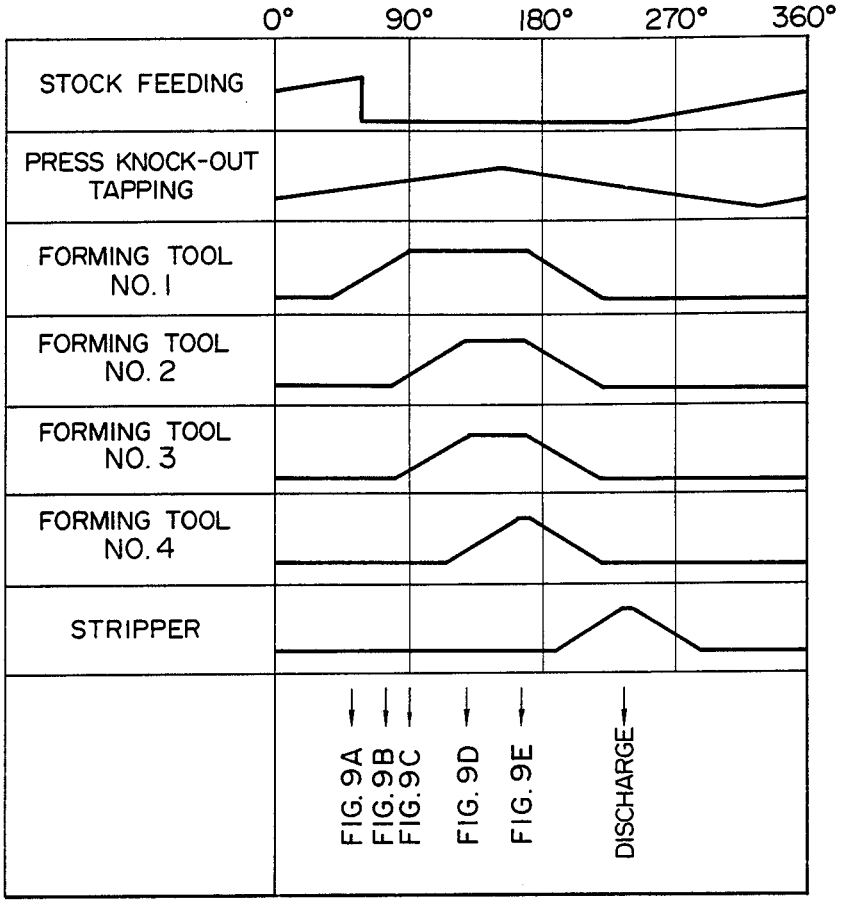
FIG. 8 is a diagram illustrating the timing a forming operation executed in a forming station.

The forming tools Nos. 1, 2, 3 and 4 and the stripper device are activated by respective cams which operate in accordance with a sequence as shown in FIG. 8. More specifically, the forming tool No. 1 operates first followed by simultaneous operation of the forming tool Nos. 2 and 3. Then, the forming tool No. 4 and the stripper device operate successively.

Figure 6:
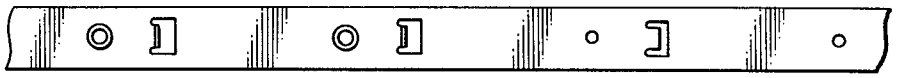
FIG. 6 is a plan view of a metal strip which has undergone several successive works in a press section before formed into the article shown in FIG. 5.
Figure 7:
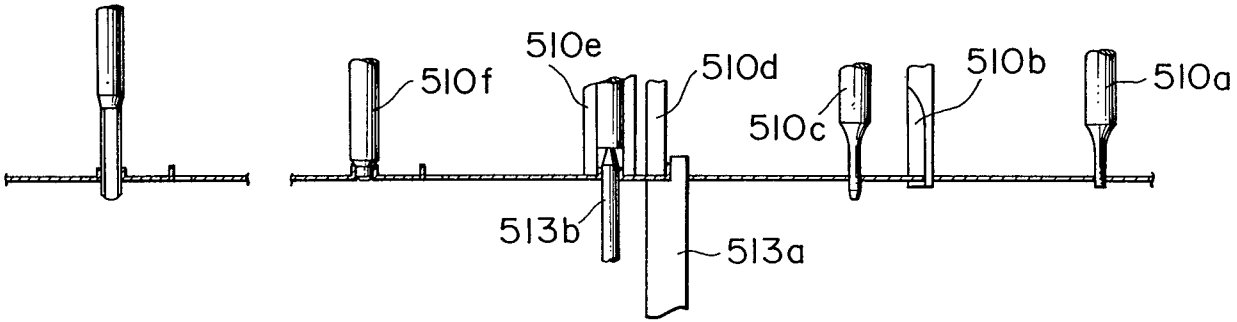
FIG. 7 is an illustration of the several successive works conducted in the press section.

The operation will be explained in more detail with reference to FIGS. 6 to 8. For the purpose of simplification of explanation, it is assumed here that the operation begins from the state in which the angle of rotation of the driving pinion 403 is zero degree in FIG. 8. Before the forming machine starts to operate, the strip extracted from the hoop is supplied to the stock feeding device 6. Then, as the drive motor 1 starts to operate, the drive shaft 13 is rotated so that the gripper cam 601 and the stock check cam 613 of the stock feeding device 6, the upper shaft 51, lower shaft 52 of the press section 5, and the central driving wheel gear 4 start to rotate simultaneously. In the stock feeding device 6, when the gripper cam 601 is in the phase for leaving the cam follower 609 from the parallel link 608, the parallel link 608 is urged towards the press section 5 by the force of the spring 257 so as to rotate the gripper lever 611 counter-clockwise thus causing the gripper 610 to cooperate with the feed block 607 in gripping the stock therebetween. During this phase the stock check cam 613 releases the fixing member 614. When the eccentric pin 602 is rotated in accordance with the rotation of the gripper cam 601, the link lever 604 is made to rock by the action of the rod 603. In consequence, the feed block 607 continues to move ahead towards the press section 5. Thus, the strip which has not been severed from the hoop yet is intermittently fed to the central forming position.

Figure 9A:
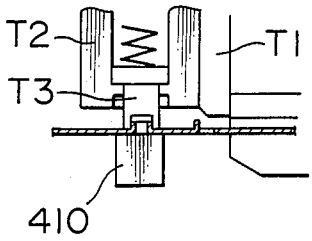
FIGS. 9*a*, 9*b*, 9*c*, 9*d* and 9*e* are schematic illustrations of forming operations conducted in the forming station.
Figure 9B:
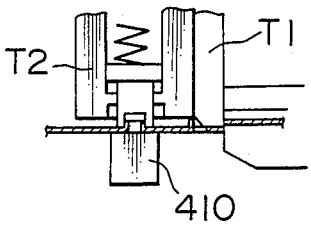
Figure 9C:
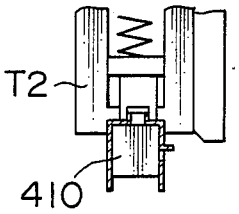
Figure 9D:
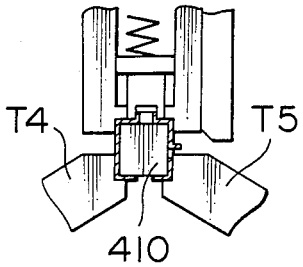
Figure 9E:
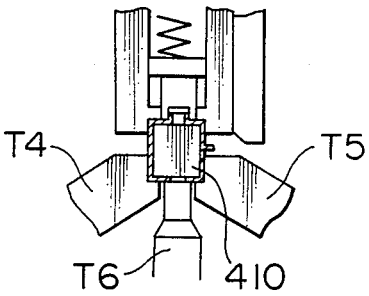

The gripper cam 601 pushes, in the later half part of its rotation, the cam follower 609 which in turn upwardly pushes the parallel link 608 through the action of the L-shaped lever 251, so that the gripper 610 of the gripper lever 611 releases the strip. Meanwhile, the stock check cam 613 causes the stock check cam lever 615 to rotate, so that the fixing member 614 clamps the strip between itself and a base member 617, thus fixing the strip against movement. Then, the feed block 607 is returned by backward movement of the link lever 604. A series of forming operations as shown in FIGS. 6 and 7 are conducted successively each time the strip as the stock is stopped. More specifically, in a first step of operation, the ram 509 is lowered by rotation of the upper shaft 51 of the press section 5, while the rotation of the lower shaft 52 causes the knock-out punch 513*a* of the knock-out unit to rise, whereby a hole is formed in the stock by the punch 510*a*. Then, the stock is fed so that the hole formed in the first step is brought to a position where a second step of operation is conducted in which the stock is perforated by a punch 510*b* and a pilot hole is formed by a punch 510*c*. Then, the stock is further fed so that the machined portion of the stock is brought to a position where a third step of operation is conducted in which a bending is effected by a cooperation between a punch 510*d* and a knock-out punch 513*a* and a burring is conducted by a cooperation between a punch 510*e* and a knock-out punch 513*b*. The stock is further moved to bring the worked portion of the stock to a position for a fourth step of operation in which a flattening punching is effected by a punch 510*f*. Then, the tapping unit 515 rotated by the upper shaft 51 is activated to effect a tapping on the hole the top brim of which has been flattened in the forth step of operation. The worked portion of the stock is then fed through the stock guide 27 to the central forming position where the mandrel 410 is placed. Meanwhile, the driving pinions of the forming tool Nos. 1, 2, 3 and 4 and the pinion 412 of the stripper are rotating in synchronism with the rotation of the central driving wheel gear 4 in a timed relation to the feeding operation of the stock, so that a series of forming operation is conducted by these forming tools. More specifically, the slide of the forming tool No. 1 is lowered as shown in FIG. 9*a* so that the pressing tool T3 presses the stock onto the mandrel 410 and then the cutting tool T1 operates to cut a piece of worked stock from the stock as shown in FIG. 9*b*. Subsequently, the U-bending tool T2 bends the stock into U-shaped form as shown in FIG. 9*c*. While the stock is still held by the U-bending tool T2, the forming tool Nos. 2 and 3 are moved upward from the left and right lower positions so that the L-bending tools T4 and T5 act to bend both ends of the U-bent stock inward in forms like L in conformity with the shape of the mandrel 410, thus imparting a cross-section of a shape as shown in FIG. 9*d* to the stock. While the stock is held by the forming tool Nos. 1, 2 and 3, the forming tool No. 4 is raised as shown in FIG. 9*e* so as to press the bend ends of the stock onto the mandrel 410 by the final pressing tool T6. Subsequently, all the forming tools are retracted and the stripper cam 414 of the stripper device pushes the stripper tool 416 forward thereby separating the formed article from the mandrel. When the separation of the formed article is completed, the gripper cam 601 and the stock check cam 613 of the stock feeding device 6 operate to feed the stock so as to bring the worked portion of the stock to the central forming position.

As has been described, in the module-type forming machine in accordance with the invention, a multiplicity of forming tools are radially mounted on the surface of a front working table 3*a* so as to be activated by a central driving wheel gear 4, so that articles having a complicated configurations can be formed without substantial difficulty. In addition, a press section 5 is selectively installed between a frame 3 of the machine and a stock feeding device 6 so as to perform various press works such as hole punching, formation of pilot hole by punching, burring, surface flattening and knock-out work, as well as works such as cut-bending, tapping and welding which cannot be performed by the forming tools arranged radially on the front working table 3*a*. Thus, the module-type forming machine of the present invention can cope with demands for the production of a variety of articles. In addition, the positions of various forming units with respect to the central forming position can be changed without difficulty, thus facilitating selection of the optimum working sequence and working positions.

What is claimed is:

1. A module-type forming machine having a frame provided on the front side thereof with a working table which extends in a vertical plane, a central driving wheel gear disposed behind said working table and mounted in said frame for rotation about an axis which is perpendicular to the plane of said working table, a forming station disposed on said axis of said central driving wheel gear and provided on the surface of said working table, a plurality of slide units attached to the surface of said working table and having the respective slides which are operatively connected to said central driving wheel gear to be slidable in the radial direction towards and away from said forming station, said slides carrying respective forming tools at their ends adjacent to said forming station, and driving means for driving said central driving wheel gear, said module-type forming machine comprising:

a base detachably attached to a lateral side of said frame and having T-shaped grooves which extend horizontally in parallel to said vertical plane of said working table;

a plurality of working units having portions received in said T-shaped grooves and fixed to said base at desired positions selected along said T-shaped grooves;

an upper shaft and a lower shaft which are rotatably supported by said base and extending in parallel with said T-shaped grooves at the upper and lower portions of said base;

means for driving said upper and lower shafts in synchronism with the rotation of said central driving wheel gear;

means for operatively connecting said working units to said upper shaft or said lower shaft; and a stock feeding device operatively connected to said central driving wheel gear for intermittently feeding a stock to said forming station past said working units, in timed relationship with operation of said slides, said connection between said stock feeding device and said central driving wheel gear being separate from said means for operatively connecting said working units to said upper shaft or said lower shaft, wherein said base is provided with a drive shaft which is engageable with said driving means for driving said central driving wheel gear, said upper shaft and said lower shaft being operatively connected to said drive shaft.

* * * * *